United States Patent [19]

Bessinger

[11] Patent Number: 4,736,918

[45] Date of Patent: Apr. 12, 1988

[54] CLAMP PLATE CANTILEVER SHELF

[75] Inventor: Walter L. Bessinger, Grand Haven, Mich.

[73] Assignee: Knape & Vogt Manufacturing Company, Grand Rapids, Mich.

[21] Appl. No.: 7,939

[22] Filed: Jan. 28, 1987

[51] Int. Cl.[4] ..... A47B 96/06

[52] U.S. Cl. ..... 248/250; 108/152; 248/235; 248/245; 312/140.3

[58] Field of Search ..... 248/250, 241, 235, 245, 248/222.1, 244, 345; 108/152, 157; 312/140.3

[56] References Cited

U.S. PATENT DOCUMENTS

| | | | |
|---|---|---|---|
| 564,519 | 7/1986 | Heysinger . | |
| 3,471,112 | 10/1969 | MacDonald et al. | 248/250 X |
| 3,704,675 | 12/1972 | Bellasalma | 108/152 |
| 4,385,565 | 5/1983 | Roberts et al. | 108/152 |
| 4,508,301 | 4/1985 | Nicholson et al. | 248/250 |
| 4,535,705 | 8/1985 | Soulakis | 248/245 X |
| 4,614,273 | 9/1986 | Ishii | 248/245 X |
| 4,691,887 | 9/1987 | Bessinger | 248/250 |

*Primary Examiner*—Ramon O. Ramirez

*Attorney, Agent, or Firm*—Price, Heneveld, Cooper, DeWitt & Litton

[57] ABSTRACT

A shelf bracket assembly for cantilever mounting shelves of varying thickness and selected material, including a bracket having a horizontal shelf support platform and a vertical wall engaging member, a clamping element engageable with a shelf on the platform and movable on the bracket to clamp a shelf thereto, and fastening means for securing the clamping element to lock the clamping element against a shelf on the platform.

14 Claims, 2 Drawing Sheets

CLAMP PLATE CANTILEVER SHELF

BACKGROUND OF THE INVENTION

This invention relates to a cantilever shelf bracket assembly.

Cantilever shelf brackets of various types have been known for many decades. In recent years, public interest has been shown in elongated cantilever shelf brackets of extruded construction, as of aluminum. Examples of such brackets are set forth in U.S. Pat. Nos. 4,508,301 and 4,385,565. Such brackets enable a wood or composite shelf of predetermined thickness to be lockingly engageable into a bracket recess so as to be tightly sandwiched between an underlying support and an overlying support. While such arrangements are effective, it is sometimes desirable to be able to accommodate shelves of widely varying thicknesses and of different materials.

SUMMARY OF THE INVENTION

The present invention provides a cantilevered shelf assembly capable of accommodating a shelf of any desired thickness, with no specific thickness limitation necessary to assemble the apparatus.

The bracket assembly of this invention is composed of special bracket components, one being a bracket to be mounted to the wall and underlie a shelf, and another being a clamping component engageable with the top of a shelf of desired thickness and secured in a locked condition to retain the shelf. The clamping component is preferably locked by a threaded fastener which engages the bracket component. Both components may be extruded as from aluminum stock.

The novel assembly is easy to manufacture, simple to install and remove, and will accommodate shelves of different thicknesses and different materials such as wood, glass, pressed board, or others.

These and other objects, advantages and features of the invention will become apparent upon studying the following specification in conjunction with the drawings.

DESCRIPTION OF THE PREFERRED EMBODIMENTS

Figure 1:
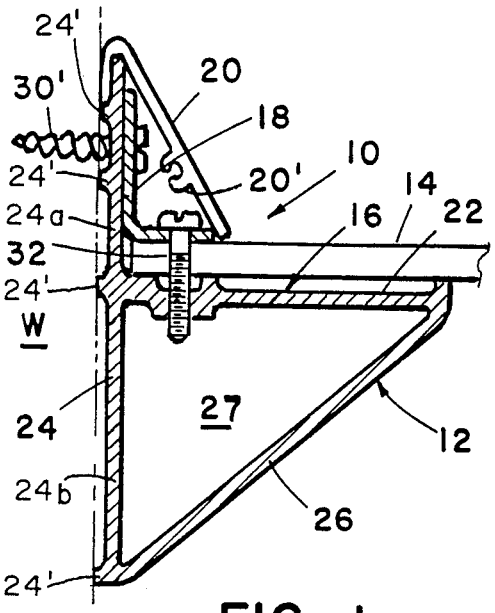
FIG. 1 is a sectional side elevational view of the first embodiment of the novel bracket assembly, with a shelf in place.

Referring now specifically to the drawings, the bracket and shelf assembly 10 depicted in FIG. 1 includes the novel bracket assembly 12 shown mounting a shelf 14 and adjacent a wall W. Assembly 12 includes a shelf bracket component 16, a clamping component 18 and an optional dress cover 20.

The shelf may be of any selected material such as wood, pressed composite board, glass or the like.

Bracket component 16 comprises an elongated member for underlying the shelf, preferably being of extruded aluminum or equivalent material. It includes a horizontally oriented portion 22, an integral upstanding rear panel 24 with wall engaging rear surface portion 24', and a diagonally downwardly rearwardly extending support and enclosure panel 26 extending from the outer front edge of panel 22 downwardly to the lower edge of vertical panel 24. These three panels enclose a space 27 which can be employed for receiving wiring or the like. Rear panel 24 has an upper portion **24*a* which extends above horizontal panel 22 and a lower portion 24*b* which extends below horizontal panel 22**.

Horizontal support platform 22 preferably includes a plurality, here shown to be three, of upstanding abutments and intermediate spaces to engage the inserted shelf 14 at the inner edge of the support platform at the outer edge of the support platform and intermediate these edges.

Clamping component 18 includes a vertical leg which lies against vertical panel 24 of the bracket component, and an integral horizontal leg which engages the upper surface of the rear edge portion of the shelf.

The shelf bracket 16 is capable of being mounted to a wall W by threaded fasteners which extend through the vertical panel 24, above the horizontal support platform, into the wall. These threaded fasteners 30, 30', etc. include some, e.g. 30, which extend only through vertical panel 24 and into the wall, and some, e.g. 30', which extend through the vertical leg of clamping component 18, through panel 24 and into the wall. Panel 24 has openings for receiving these threaded fasteners, such openings being optionally threaded or unthreaded. Clamping bracket 18 includes downwardly laterally diagonally oriented slots **18*a* through which threaded fasteners 30' extend. Thus, when fasteners 30' are not fully secured, bracket 18 may be laterally-downwardly shifted or alternatively laterally (in the opposite direction) upwardly shifted to clamp or unclamp shelf 14. Thus, the clamp is able to accommodate shelves of different thicknesses between horizontal support 22 and clamping element 18, following which fasteners 30'** are secured tightly to hold the rear of the shelf downwardly even if under load.

Figure 2:
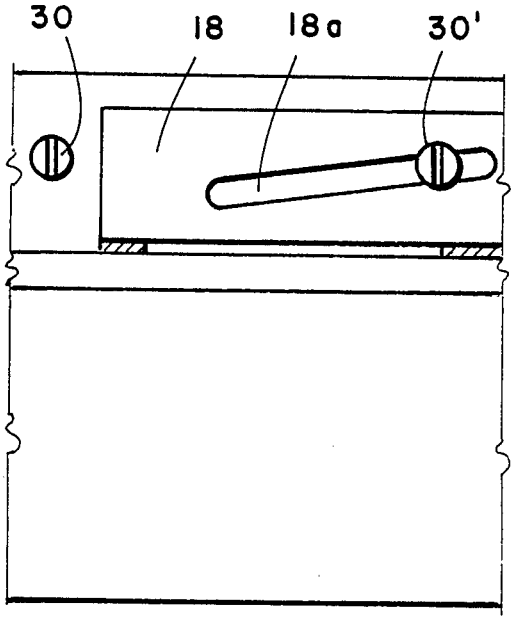
FIG. 2 is a fragmentary front elevational view of a portion of the assembly in FIG. 1.

If desired, an optional vertical threaded fastener 32 may extend between clamping element 18 and horizontal support 22, through a suitable opening in shelf 14. In the depicted version of FIGS. 1 and 2, this threaded fastener has its head against the horizontal portion of upper clamping element 18, and its threaded portion threadably engaged with a threaded socket of platform 22.

The fasteners can be conveniently covered by a dress strip 20 which extends diagonally upwardly rearwardly over the clamping element and the threaded fasteners, including for example a U-shaped portion which will hook behind panel 24 at its upper edge. A suitable socket 20' can be provided in this dress element for connection to end caps (not shown) if desired.

SECOND EMBODIMENT

Figure 3:
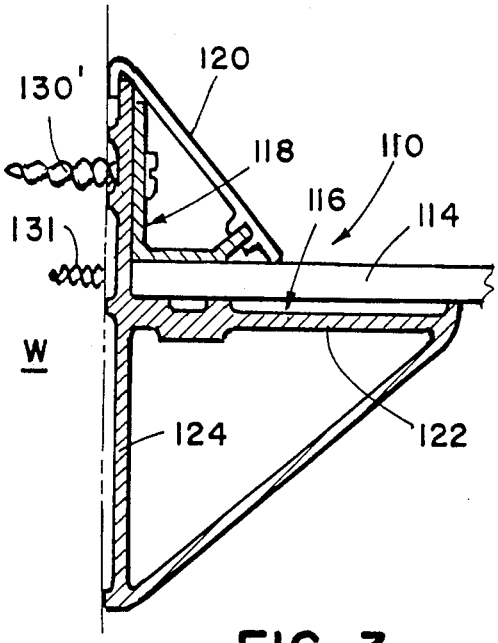
FIG. 3 is a sectional side elevational view of the second embodiment of the novel bracket assembly.
Figure 4:
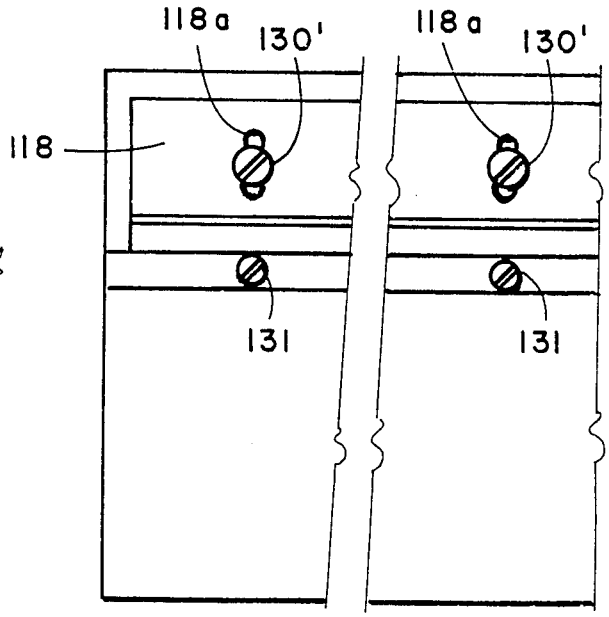
FIG. 4 is a fragmentary front elevational view of the assembly in FIG. 3.
Figure 5:
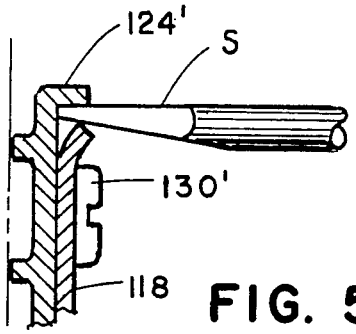
FIG. 5 is an enlarged fragmentary sectional side elevational view of the assembly in FIGS. 3 and 4.

In FIGS. 3, 4 and 5 is illustrated a second embodiment 110 which includes a wall mounted shelf bracket 116, and a clamping component 118, both mounting a shelf 114. Bracket 116 includes a vertical panel 124 which lies against the wall W and has a plurality of fasteners 130' which extend through the vertical leg of clamp 118, the vertical panel 124 of the wall bracket, and into the wall with a threaded engagement. Dress strip 120 is shown having its upper end hooked over the top edge of panel 124, and a slot on its lower portion interengaged with a diagonally upwardly outwardly oriented end portion of the horizontal component of clamp 118. In this embodiment, clamp 118 has vertically oriented slots 118*a* instead of diagonally oriented slots as in FIG. 2. Clamp 118 therefore is movable directly up and down to clamp the rear portion of a shelf onto the support platform 122 of the shelf bracket. In this embodiment, additional threaded fasteners such as wood screws 131 extend through vertical panel 124 directly into the wall, such being located directly behind the rear edge of the shelf so as to be covered by the inserted shelf.

In this embodiment also, the shelf can be of varying thickness but still capable of being fixedly clamped to the support by downward movement of clamping component 118. Optionally, the upper edge of panel 124 may be oriented forwardly as at edge 124' in FIG. 5 to form an underlying prying surface for insertion of a tool such as a screwdriver S between this flange and the upper edge of clamp 118. Hence, when the fasteners 130' are still loose, clamp 118 can be pried downwardly against the rear edge portion of shelf 114, followed by tightening of the fasteners to secure the entire assembly.

Optionally, threaded fasteners 32 can also be employed between the clamp and the underlying shelf support, if desired.

THIRD EMBODIMENT

Figure 6:
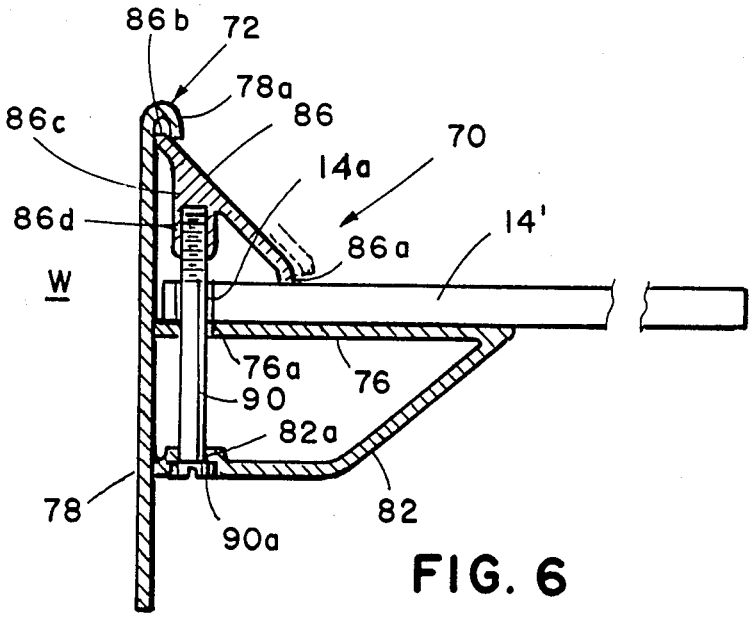
FIG. 6 is a side elevational sectional view of the third embodiment of the invention.

Assembly 70 in FIG. 6 includes shelf 14' having one or more openings 14*a* toward the rear edge thereof. Shelf bracket assembly 72 in this embodiment includes the vertical wall engaging panel 78 for engaging wall W, horizontal platform 76 having diagonally downwardly rearwardly extending compression panel 82 which joins panel 78 integrally as does platform 76. In this embodiment, the vertical panel 78, platform 76 and panel 82 are integral with each other. Overlying compression support on the rear edge of the shelf is provided by an overhanging downwardly forwardly extending pivot clamp 86 which includes a shelf engaging foot 86*a* on the elongated lower end and an enlarged cylindrical pivotal upper edge 86*b* on the elongated upper end received in a retaining socket 78*a* on the upper end portion of panel 78. Pivot member 86*b* can be longitudinally inserted in socket 78*a*, for example, or the connection formed by deforming the socket around the cylindrical edge. An enlarged vertical downwardly depending foot 86*c* depends from the underside of member 86 intermediate its upper and lower ends, and including a threaded socket 86*d* therein. An elongated threaded fastener 90 extends upwardly through an opening 82*a* in panel 82, through an opening 76*a* in platform 76 and through an opening 14*a* in shelf 14', to be threadably received and secured in threaded socket 86*d*. The enlarged head 90*a* on bolt 90 bears against the undersurface of panel 82 such that with tightening of this threaded bolt, pivot clamp 86 is pivotally lowered into secure engagement with shelf 14' to retain it against platform 76. This clamp therefore also serves as a dress cover.

It is conceivable that the invention taught herein and shown by the illustrative preferred embodiments may be modified in certain respects to accommodate particular situations. Therefore, it is intended that the invention is to be limited only by the scope of the appended claims and the reasonably equivalent structures to those defined therein rather than to the illustrative embodiments set forth.

The embodiments of the invention in which an exclusive property or privilege is claimed are defined as follows.

1. A shelf bracket assembly comprising:

a bracket having a horizontal shelf support platform and a vertical wall engaging member;

said member having a lower portion below the level of said platform and an upper portion above the level of said platform;

a clamp above said platform to engage a shelf on said platform, said clamp being a separate element from said bracket;

a movable interfit between said clamp and said upper portion allowing said clamp to move on said bracket relative to said platform and said wall engaging member, and fastener means for locking said clamp against a shelf on said platform.

2. The shelf bracket assembly in claim 1 wherein said clamp has slot means for receiving said fastener means.

3. The shelf bracket assembly in claim 2 wherein said slot means has a vertical dimension and said fastener means is threaded.

4. The shelf bracket assembly in claim 3 wherein said slot means is diagonally oriented.

5. The shelf bracket assembly in any of claims 1–4 including a dress plate engageable over said upper portion and said clamp.

6. The shelf bracket assembly in claim 1 wherein said fastener means extends through said clamp and said upper portion and said clamp is movable relative to said upper portion when said fastener means is not tightened, to allow clamping action on a shelf, and said clamp is locked against movement when said fastener means is tightened.

7. The shelf bracket assembly in claim 6 wherein said clamp has elongated slots through which said fastener means extend for enabling clamp movement.

8. The shelf bracket assembly in claim 7 wherein said slots have a vertical dimension.

9. The shelf bracket assembly in claim 7 wherein said slots are diagonally oriented.

10. A shelf bracket assembly for supporting a shelf in cantilever fashion, comprising:

a shelf bracket having a horizontal platform and a vertical wall engaging portion integral with said platform and extending above the level of said platform and below the level of said platform;

an elongated shelf clamp above said platform, connected to said wall engaging portion, having a horizontal shelf engagement surface, and slidably movable toward and away from said platform to engage a shelf thereon; and means engaging said shelf clamp for locking said shelf clamp against movement away from said platform, to cause said horizontal shelf engagement surface to clamp a shelf to said platform.

11. The shelf bracket assembly in claim 10 wherein said locking means comprises threaded fastener means extending through said shelf clamp and said wall engagement portion of said shelf bracket.

12. The shelf bracket assembly in claim 10 wherein said clamp is pivotally connected to said wall engaging portion.

13. The shelf bracket assembly in claim 12 including threaded fastener means projecting up through said platform into threaded engagement with said pivotal shelf clamp to form said locking means.

14. The shelf bracket assembly in claim 12 wherein said clamp extends downwardly and outwardly to form a dress cover as well as said clamp.

* * * * *